US006595520B1

(12) United States Patent
Richards et al.

(10) Patent No.: US 6,595,520 B1
(45) Date of Patent: Jul. 22, 2003

(54) METHOD OF CONDUCTING A MULTIPLE HAND CARD GAME

(76) Inventors: David J. Richards, 2300 E. Patrick La., Las Vegas, NV (US) 89119; Kimberly Gale Young, 6530 Annie Oakley #2817, Henderson, NV (US) 89014; Spencer Caroll Peterson, 1026 Secluded Acres Ct., Henderson, NV (US) 89015

( * ) Notice: Subject to any disclaimer, the term of this patent is extended or adjusted under 35 U.S.C. 154(b) by 0 days.

(21) Appl. No.: 10/120,081

(22) Filed: Apr. 9, 2002

Related U.S. Application Data

(60) Provisional application No. 60/282,688, filed on Apr. 9, 2001.

(51) Int. Cl.[7] ..... A63F 1/00

(52) U.S. Cl. ..... 273/292; 273/274; 273/309; 463/12; 463/13; 463/25

(58) Field of Search ..... 273/292, 274, 273/309; 463/13, 12, 25, 28

(56) References Cited

U.S. PATENT DOCUMENTS 5,544,892 A * 8/1996 Breeding ..... 273/292
5,823,873 A * 10/1998 Moody ..... 463/13
6,007,066 A * 12/1999 Moody ..... 273/292
6,019,374 A * 2/2000 Breeding ..... 273/292
6,048,267 A * 4/2000 Wichinsky ..... 463/13
6,098,985 A * 8/2000 Moody ..... 273/292
6,129,357 A * 10/2000 Wichinsky ..... 273/292
6,132,311 A * 10/2000 Williams ..... 463/13
6,334,614 B1 * 1/2002 Breeding ..... 273/292
6,435,509 B2 * 8/2002 Wichinsky et al. ..... 273/292
6,454,266 B1 * 9/2002 Breeding et al. ..... 273/292

OTHER PUBLICATIONS

Breeding et al.—Bet Withdrawal Casino Game With Wild Symbol–Pub. Date Mar. 07, 2002, Pub. No.: US 2002/0027322 A1.*

Breeding et al.—Card Shuffler with Sequential Card Feeding Module and Method of Delivering Groups of Cards—Pub. Date May 30, 2002 Pub. No.: US 2002/0063389 A1.*

* cited by examiner

*Primary Examiner*—Benjamin H. Layno
*Assistant Examiner*—Dolores R. Collins
(74) *Attorney, Agent, or Firm*—Anderson & Morishita; Robert Ryan Morishita

(57) ABSTRACT

A card game begins with designating at least one playing card to be a substitute card and defining a substitution pattern for the substitute cards: The first player is dealt a first player hand of cards. The player plays the first player hand to completion and receives at least one additional player hand of cards. For each additional hand, the substitute cards are copied into other player hands to replace a card in that hand, according to the substitution pattern, only if the substitution results in a higher poker ranking for the hand. Players are rewarded based on the final poker ranking of each player hand after substitution, if any.

14 Claims, 12 Drawing Sheets

METHOD OF CONDUCTING A MULTIPLE HAND CARD GAME

RELATED APPLICATION DATA

This application claims the priority of U.S. Provisional Application Ser. No. 60/282,688 entitled "Electronic Video Poker Games" filed Apr. 9, 2001 by Applicants herein.

FIELD OF THE INVENTION

The present invention relates to casino video games. More specifically, the present invention is a multiple hand video poker game that includes the possibility of a chance improvement of a hand by cards from another hand.

BACKGROUND OF THE INVENTION

Video draw poker is well known. In the conventional game of video draw poker known in the art, a gaming device is provided wherein the player makes a wager and the device's processor selects from a data structure containing data representing cards in a deck of playing cards, five cards to be displayed face up to represent an initial hand. The player selects which, if any, of the five cards of the initial hand to hold and prompts the processor to discard the remaining cards. The discarded cards are replaced with replacements selected from the data structure to produce a final hand outcome of a five card poker hand. The video draw poker device compares the final outcome to the predetermined winning combinations also stored in a data structure, these combinations frequently representing ranked poker hands. If the player's final outcome matches a winning combination, the player is rewarded. Otherwise, the final outcome is deemed to be a loss and the player's wager is retained.

In a variation of video draw poker, multiple hands may be provided. As with conventional video draw poker, the device's processor randomly deals five cards to a player for an initial hand. The player selects which, if any, of the five cards of the initial hand to hold. Prior to drawing replacement cards for the initial hand, the held cards are copied into the other hands. The player prompts the processor to discard the remaining cards and additional cards are drawn to replace the discarded cards. The processor then repeats the draw step for the additional hands. Thus, a player receives multiple opportunities to draw to the same held cards.

SUMMARY OF THE INVENTION

The method of the present invention is a game utilizing playing cards. At least one playing card is designated a substitute card; optionally a set of cards may be designated substitute cards. Also, a substitution pattern is defined for the substitute cards.

In the wagering form of the game, a player makes a wager for each player hand of cards to be dealt. After the wagers are placed, a first player hand of playing cards is dealt face up. The number of cards in a hand may vary, but it is contemplated that any number between two and five may be selected. The first player hand is played to completion. For example, in an optional embodiment based on Draw Poker, five cards are dealt and the player selects zero or more cards to be held. Cards not held are discarded and the first player hand is completed by dealing additional cards to replace the discarded cards.

At least one additional player hand of cards is dealt. While the number of cards could vary, it is contemplated that the additional player hands will each include the same number of cards as the first player hand.

If any of the additional player hands contain one or more cards designated as substitute cards, the substitute cards will replace one or more cards in another player hand according to the predefined substitution pattern, so long as the substitution improves the poker ranking of the hand receiving the substitute card. In other words, the substitute card will replace any card of another hand, according to the predefined substitution pattern, if doing so improves the poker rank of the receiving hand. This process will be repeated for each of the hands.

It is contemplated that the substitution pattern could take any form. For example, in one optional embodiment, the cards of the player hands are arranged into arrays and any substitute card may only replace a card in a corresponding array position in another player hand. In a another optional embodiment, the player hands themselves are arranged serially with each player hand adjacent at least one other player hand. In such an embodiment, substitute cards may replace cards in an adjacent hand.

After substitution, if any, the player is rewarded based on the final poker hands. For example, in one optional embodiment, a fixed paytable is utilized such that players are rewarded based on the final poker ranking of each individual player hand.

DESCRIPTION

Figure 1:
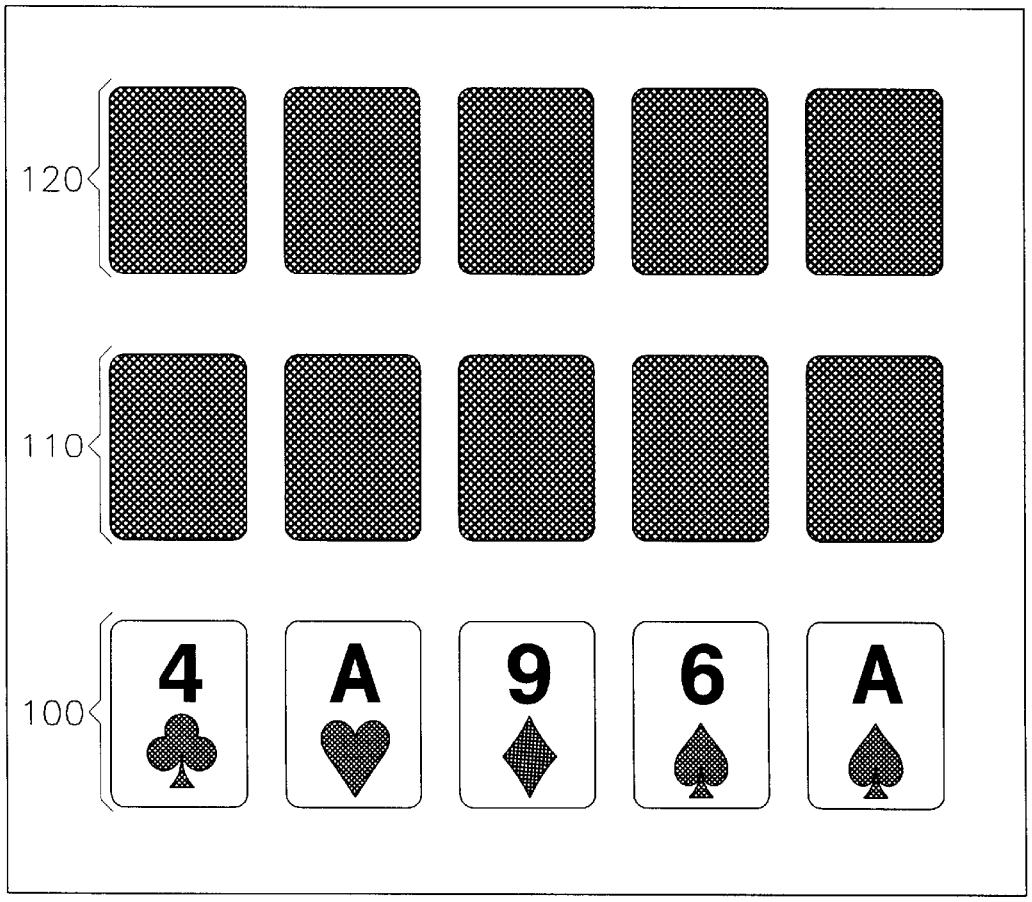
FIG. 1 shows a screen display according to an embodiment of the present invention after the initial deal of the cards.

Reference is now made to the figures wherein like parts are referred to by like numerals throughout. The present invention is a method for playing a multiple player hand poker game. The present method could be conducted in a live setting or in an electronic form, such as via the Internet, via an intranet or other computer network, or on an electronic video machine.

The present method is played using playing cards, such as one or more conventional playing card decks. Referring to FIG. 12, the present invention begins by designating 26 at least one playing card to be a substitute card. In an optional embodiment, multiple substitute cards may be designated 26. Substitute cards may be fixed or may be randomly selected prior to the start of each game. It is also contemplated that, in one optional embodiment, a player may choose to designate one or more specific cards as substitute cards prior to the start of a game. While any playing card, including Jokers, designated wild cards, supplemental cards, or the like could be designated substitute cards, in the optional embodiment of FIGS. 1–11, Aces have been designated as substitute cards.

A substitution pattern is also defined 32 for the substitute card or cards. The purpose of the substitution pattern is described in greater detail below. Generally speaking, the substitution pattern is the set of rules for the way the substitute cards replace cards in other player hands.

In a wagering format of the game, a player places 20 a wager. In one optional, the wager placed 20 y the player determines the number of hands that will be played. In such an embodiment, a player wagers by designating the number of hands to be played and a quantity to be wagered on each hand. It is also contemplated, however, that a player may make a wager and an the wager will be automatically allocated among active hands.

An first player hand of cards is dealt 22 to the player. It is contemplated that any number of cards may be dealt as an first player hand, however, in an optional embodiment shown in FIGS. 1–11, five cards are dealt.

Referring again to FIG. 12, the player plays 24 the first player hand to completion. By stating that the first player hand is played 24 to completion, it is contemplated that the first player hand may be played according to the rules of draw poker, stud poker, or any other card game method. In the optional embodiment of FIGS. 1–11, completing the first player hand involves the steps of selecting zero or more cards to hold and discarding those cards. The first player hand is completed by dealing additional cards to replace discarded cards. The poker rank of the completed first player hand is determined.

With continued reference to FIG. 12, at least one additional player hand is dealt 22. The additional player hands could be dealt 22 after completion of the first player hand or, in another optional embodiment, with the first player hand and kept facing down until the first player hand is completed or they could be dealt after the first player hand is completed. Again, any number of cards may be dealt to each additional player hand, however, in the optional embodiment of FIGS. 1–11, five cards are dealt to form each additional player hand. While the embodiment shown in FIGS. 1–11 shows each player hand dealt from a separate, complete deck, it is contemplated that the additional player hands could be dealt from a deck depleted of the cards of the first player hand in an alternate optional embodiment. The additional player hands could be operated in any manner, in an optional embodiment, the additional player hands are stud poker hands. That is, in such an optional embodiment, the player cannot select cards to hold from the player hand and draw replacements. However, as described below, substitutions from other player hands may occur.

The additional player hands are examined 28 for substitute cards. For each substitute card in the additional player hands, the substitution pattern is tested 30 and, if the substitution pattern would yield a higher poker ranking for the player hand receiving the substitute card, a replica of the substitute card replaces 34 a card in the other player hand. For example, referring to FIGS. 1–6, the cards of the initial player hand and the additional player hands are dealt into five card arrays with the player hands stacked vertically in serial fashion, that is, the first player hand is the lowest hand and the additional player hands are located vertically above the first player hand. In the optional embodiment of FIGS. 1–6, the substitution pattern restricts substitute cards to replace cards in other hands that are vertically aligned in a corresponding position with the substitute card. The embodiment of FIGS. 1–6 is described in greater detail below.

Stated another way, replicas of the substitute cards of a player hand are used to replace cards of another player hand, including the first player hand, according to the substitution pattern so long as the rank of the hand receiving the replacement is improved. This process is repeated for each additional player hand. It is important to note that the substitute cards themselves will not move into other player hands; rather replicas of the substitute cards will act to replace cards of the other player hands according to the substitution pattern. Consequently, it is entirely possible that a holding of Five of a Kind could be obtained because one or more replicas of substitute card could be copied into a player hand already holding one or more matching substitute cards. It is also important to note that the substitution could take place at any point in the game method. More specifically, while the substitution step in the optional embodiment of FIG. 12 is shown as occurring after the first player hand is played to completion, it is contemplated that the substitution step could occur at any point during the method including before or after drawing cards to a first player hand.

The substitution pattern could take many forms. While the substitution pattern of the optional embodiment shown in FIGS. 1–11 is a "vertically down" pattern, it is contemplated that many other patterns could be use. For example, a "vertically up" pattern, a "vertically up and down" pattern, a diagonal pattern, or any other direction could be used. Additionally, it is contemplated that the substitution pattern could be limited to adjacent hands only or may permit skipping of intermediate hands. Finally, it is contemplated that the substitution pattern may be serial, such as that shown in the embodiment of FIGS. 1–11, in which substitute cards received from another player hand are eligible to act as substitute cards until stopped by a non-substitution caused by the fact that a substitution would not improve the receiving player hand. That is, as shown in FIGS. 1–11, replicas of the substitute cards could cascade downward from the uppermost player hand to the intermediate player hand and into the first player hand.

After the replacements occur, the poker ranking of each player hand is determined and a reward is issued 36. In one optional embodiment, each player hand is rewarded separately such that a player may be rewarded on none, some, or all player hands depending on the poker rank of each individual poker hand. Any suitable pay table may be used for this multiple hand implementation of the poker game.

For illustration purposes, representative pay tables are shown in TABLE 1, TABLE 2, and TABLE 3.

It is contemplated that the present invention could be conducted on an electronic gaming machine. Such an electronic gaming machine would include a processor, a display communicating with the processor, an input device, and a data structure storing instructions for the processor, paytables, and images of playing cards. In such an embodiment, the processor would display the hands at the display and selections would be made using buttons on the button panel of the gaming device, a touch screen, or other input device.

Reference is now made to two complete games shown in FIGS. 1–6 and 7–11, respectively. Referring first to FIGS. 1–6, in this example game of an optional embodiment all cards that have the rank of Ace have been designated as substitute cards and the substitution pattern directs that substitute cards may replace vertically aligned cards in the next lower hand if it improves the poker rank of the next lower hand. FIG. 1 shows the layout for the first player hand in this example game. The player has made three wagers: the first wager is on the bottom row 100, the second wager is on the middle row 110, and the third wager is on the top row 120. Thus, the player is playing three hands. Three rows of cards are initially dealt. The bottom row 100 is dealt face up; the middle row 110 and the top row 120 are dealt face down.

Figure 2:
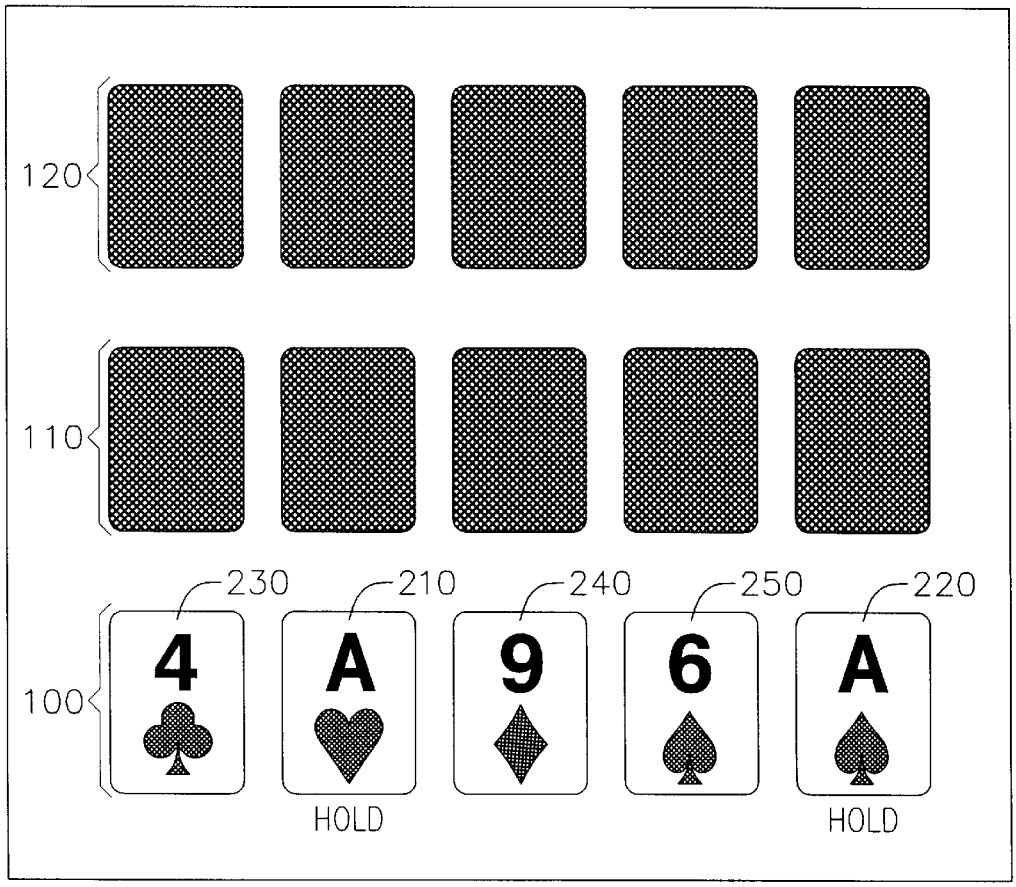
FIG. 2 shows a screen display according to the embodiment of FIG. 1 after the player has selected the cards he wishes to hold from the bottom row.
Figure 3:
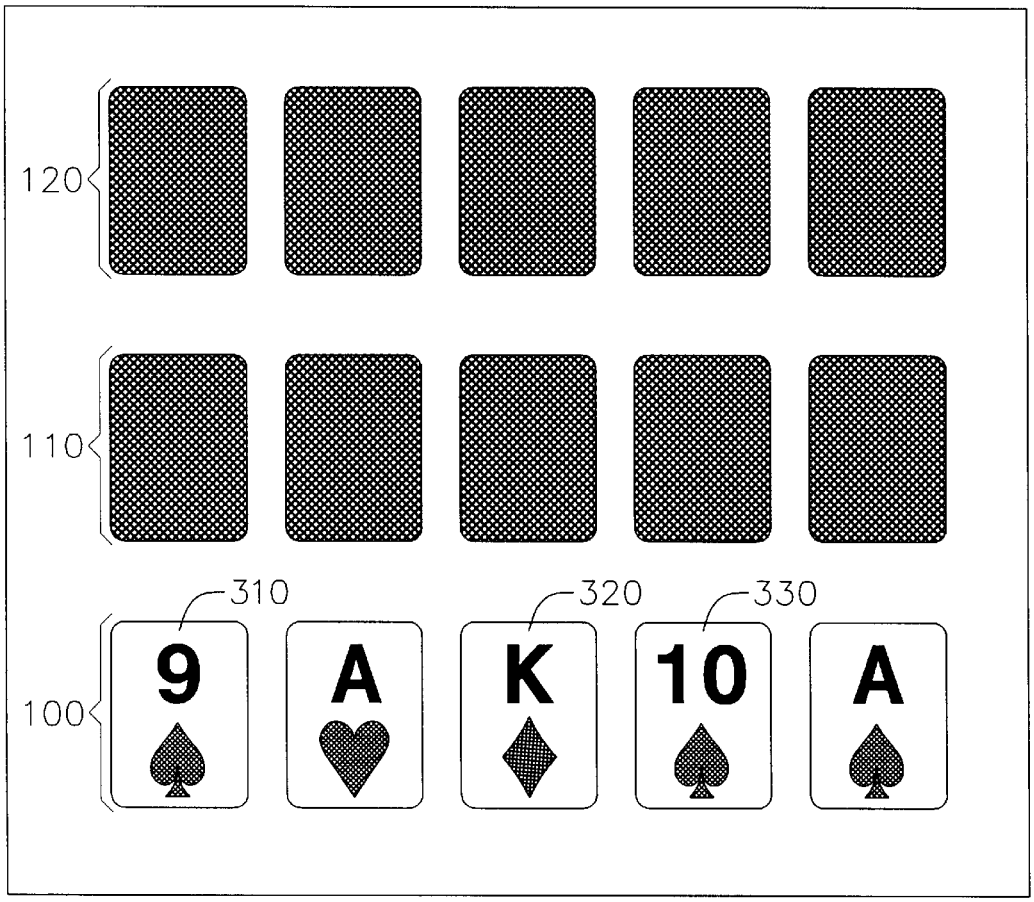
FIG. 3 shows a screen display according to the embodiment of FIG. 1 after the replacement cards were issued for the bottom row.

The player selects those cards in the bottom row 100, i.e. the first player hand, that he wishes to hold. The player may elect to hold from zero to five cards from the bottom row 100. FIG. 2 shows the cards Ace of Hearts 210 and Ace of Spades 220 that were selected to be held from the bottom row 100. Cards not selected to be held 230 240 250 will be replaced with new cards dealt face up to the bottom row 100. FIG. 3 shows the hand of the bottom row 100 with the new replacement cards 310 320 330.

Figure 4:
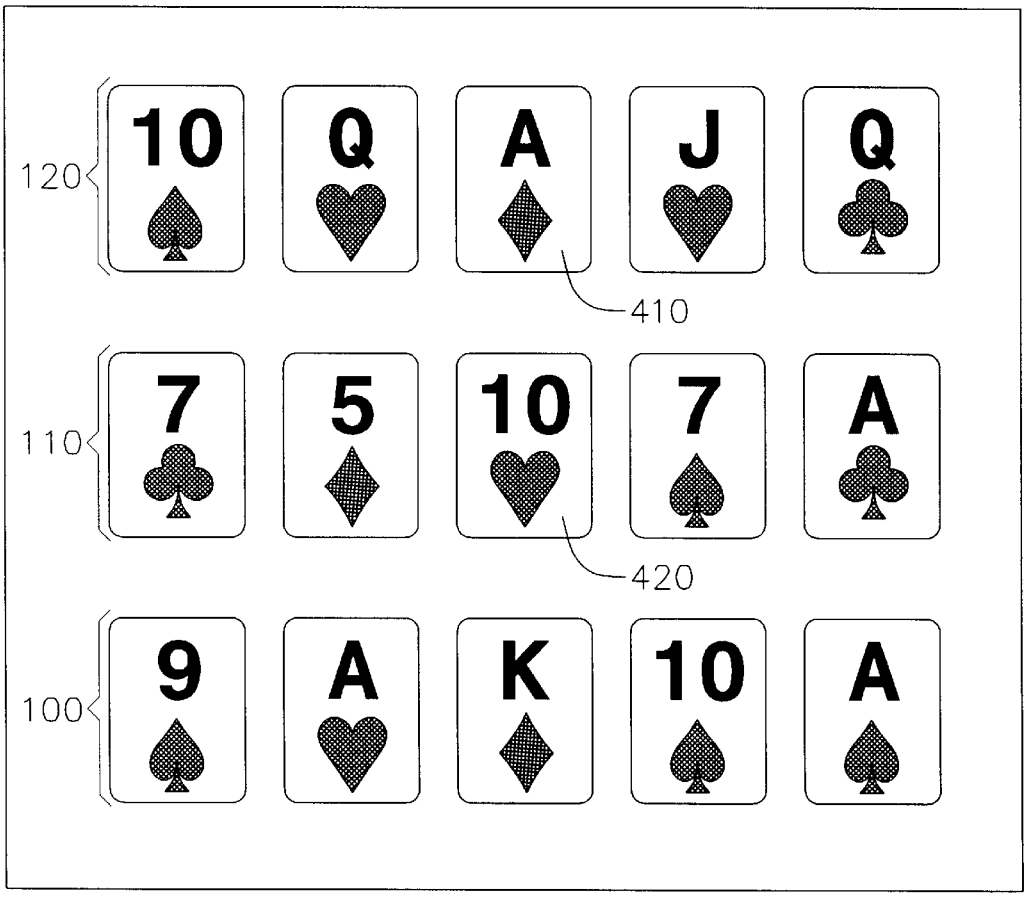
FIG. 4 shows-a screen display according to the embodiment of FIG. 1 after the cards in the top row and center row have been revealed.

FIG. 4 shows the additional player hands in the middle row 110 and the top row 120, after the replacement cards were issued for the bottom row 100. The screen displays the fifteen cards comprising the three separate poker hands 100 110 120. The top hand 120 contains the Ace of Diamonds 410 which has been designated as a bonus card for this example game of an optional embodiment.

Figure 5:
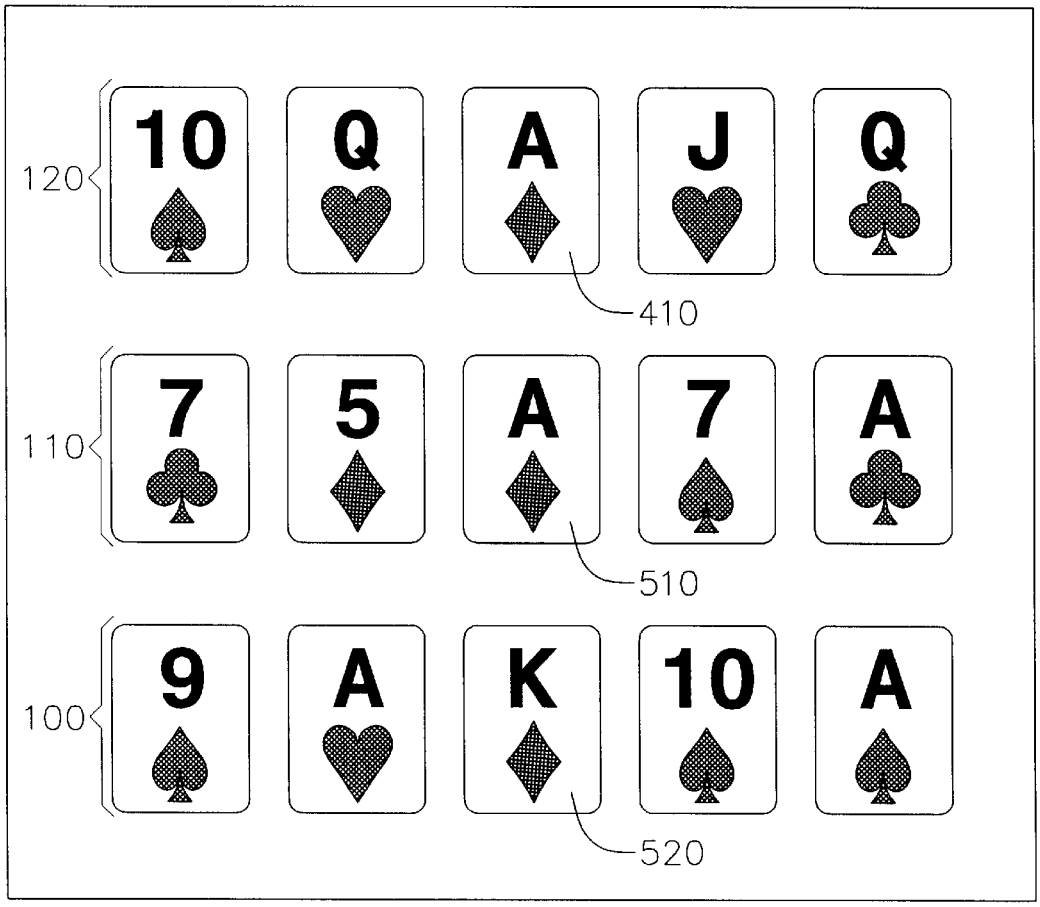
FIG. 5 shows a screen display according to the embodiment of FIG. 1 after the Ace of Diamonds in the top row has been duplicated and replaced the Ten of Hearts in the middle row.

FIG. 5 shows that the Ace of Diamonds 410 from the top row 120 has been replicated and has replaced the Ten of Hearts 420 (FIG. 4) from the middle row 110. This replacement has happened because by replacing the Ten of Hearts 420 (FIG. 4) with the Ace of Diamonds 510 we have improved the rank of the middle hand 110 from a Pair of Sevens to a hand ranking as Two Pair Aces and Sevens.

Figure 6:
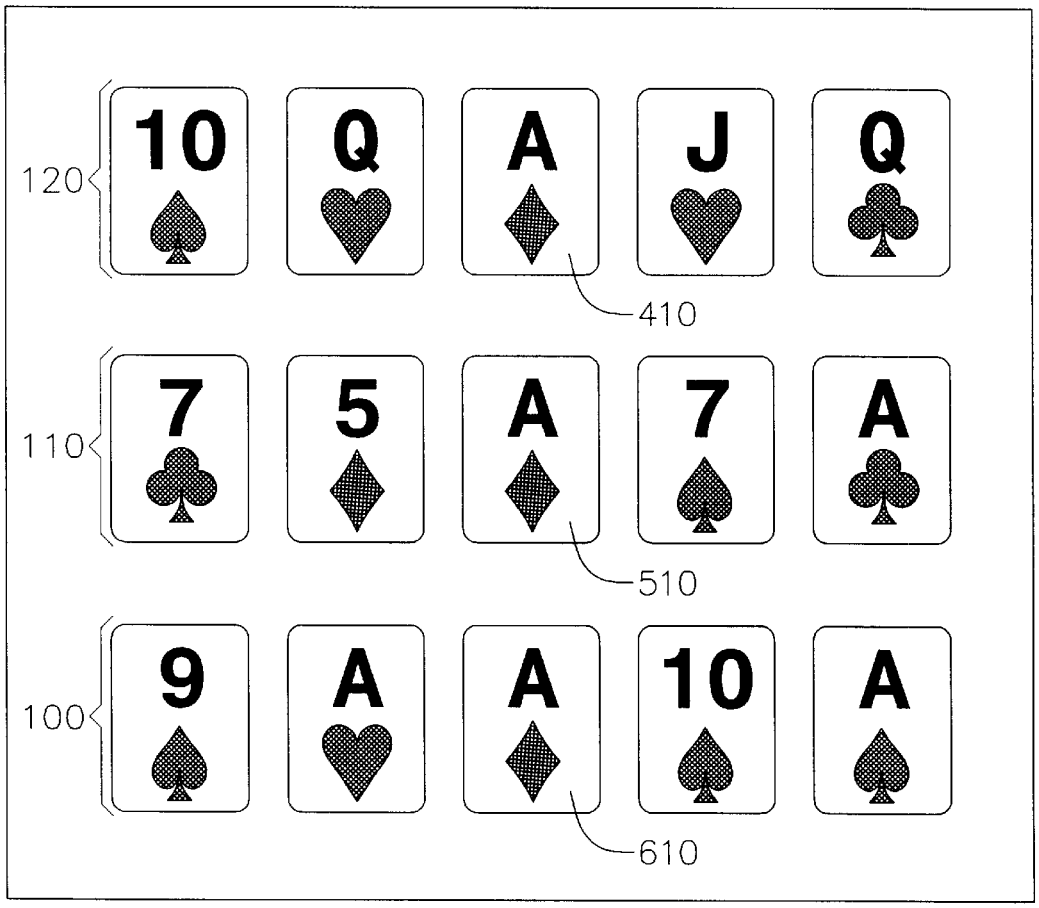
FIG. 6 shows a screen display according to the embodiment of FIG. 1 after the Ace of Diamonds in the middle row has been duplicated and has replaced the King of Diamonds in the bottom row.

FIG. 6 shows that the Ace of Diamonds 510 from the middle hand 110 has been duplicated and has replaced the King of Diamonds 520 (FIG. 5) from the bottom hand 100. This replacement has happened because by replacing the King of Diamonds 520 (FIG. 5) with the Ace of Diamonds 610 the rank of the lower hand 100 has improved from a Pair of Aces to Three of a Kind Aces. Had the Ace of Diamonds 5 10 not improved the bottom hand. 00, the replication and replacement would not have occurred. At this point the games is over and all three hands in which the player wagered on will be evaluated and paid according to the pay schedule.

FIGS. 7–11 illustrate another example game of an optional method of play of the present invention. In this embodiment, all cards of rank Ace are designated to be substitute cards and the substitution pattern directs that substitute cards may replace any vertically aligned card from any hand lower than the hand with the substitute card if by doing so it would improve the poker hand rank of the lower hand.

Figure 7:
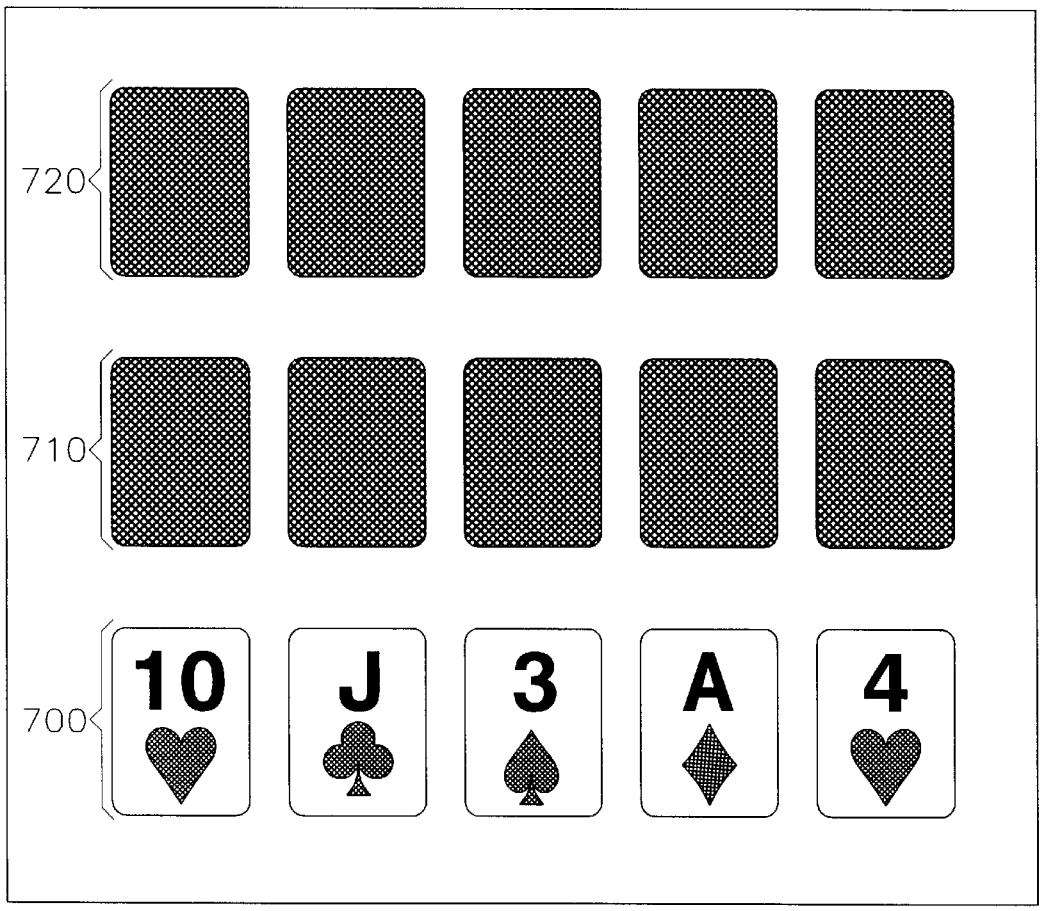
FIG. 7 shows a screen display according to an alternate embodiment of the present invention after the initial deal of the cards.

FIG. 7 shows three rows of cards that are initially dealt with the first player hand 700 having its cards dealt face up. The middle hand 710 and the upper hand 720 are dealt face down.

Figure 8:
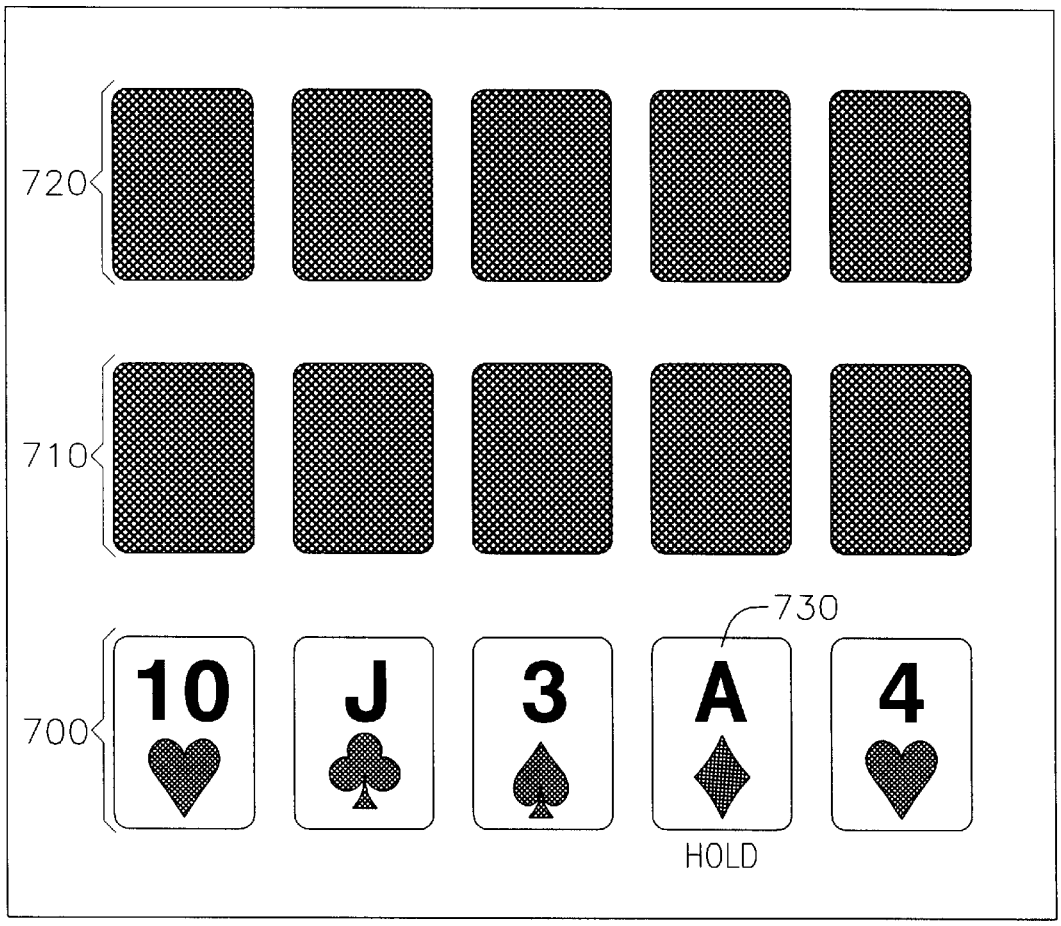
FIG. 8 shows a screen display according to the embodiment of FIG. 7 after the player has selected the cards he wishes to hold from the bottom row.

FIG. 8 shows that the player has selected to hold the Ace of Diamonds 730.

Figure 9:
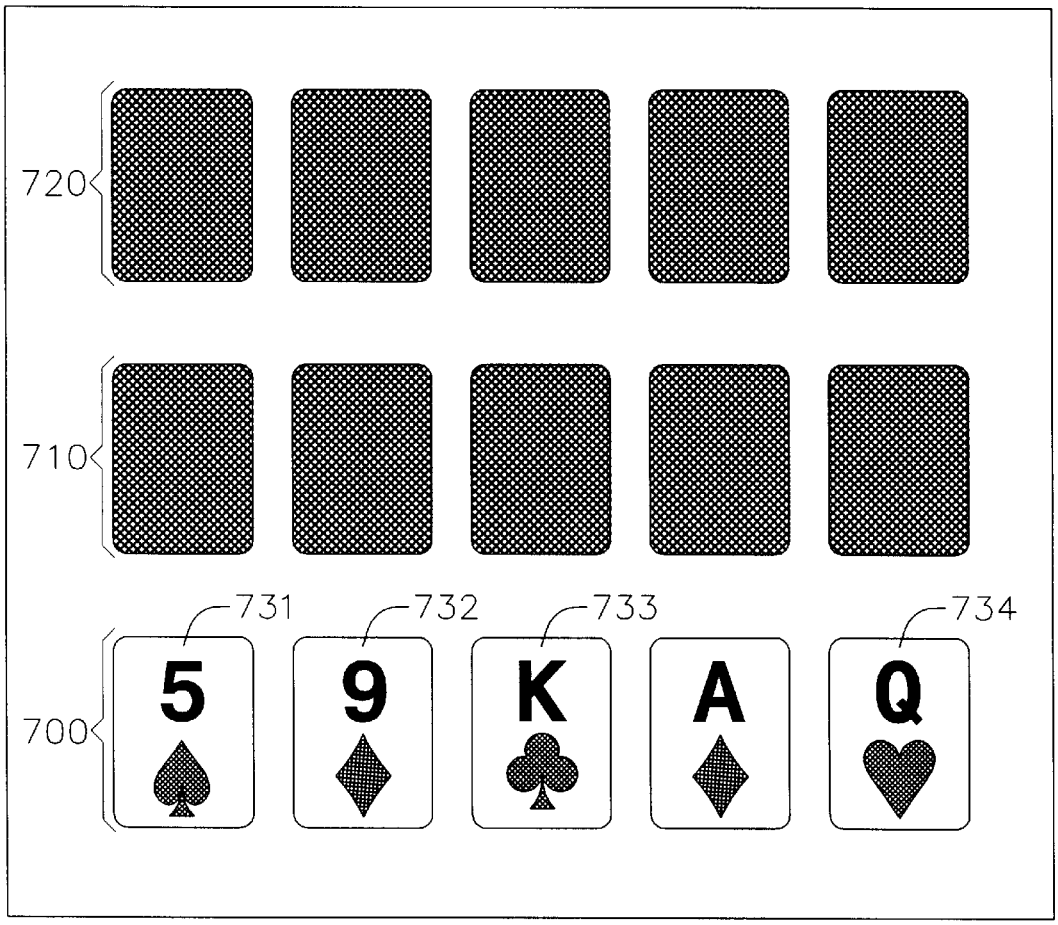
FIG. 9 shows a screen display according to the embodiment of FIG. 7 after the replacement cards were issued for the bottom row.

FIG. 9 shows that the player has received new cards 731 732 733 734 in the first player hand 700 for the cards the player did not select to keep before pressing the "deal" button.

Figure 10:
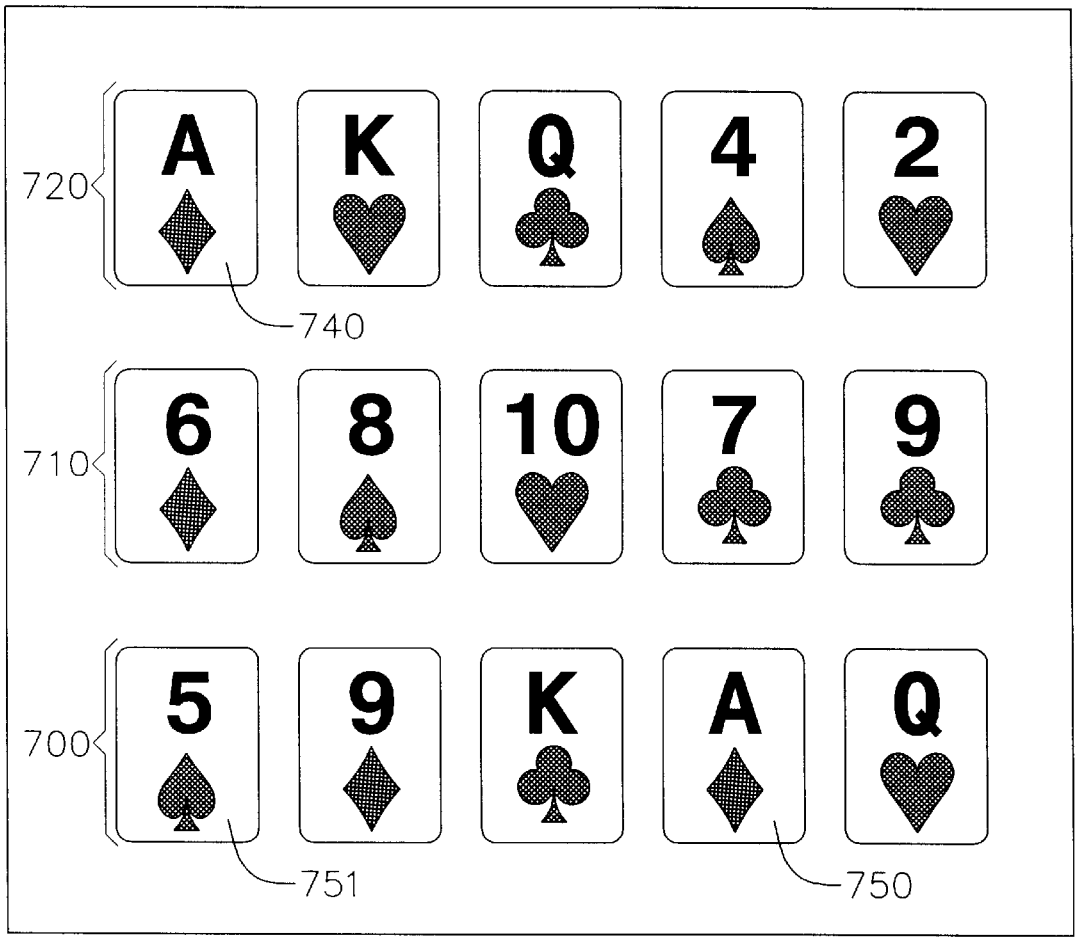
FIG. 10 shows a screen display according to the embodiment of FIG. 7 after the cards in the top row and center row have been revealed.

FIG. 10 shows the screen after the "deal" button has been pressed with all of the cards revealed for both the top hand 720 and the middle hand 710. We also see that the player has received an Ace of Diamonds 740 a substitute card in the top hand 720 and the player was dealt an Ace of Diamonds 750 a substitute card in the bottom hand 700.

Figure 11:
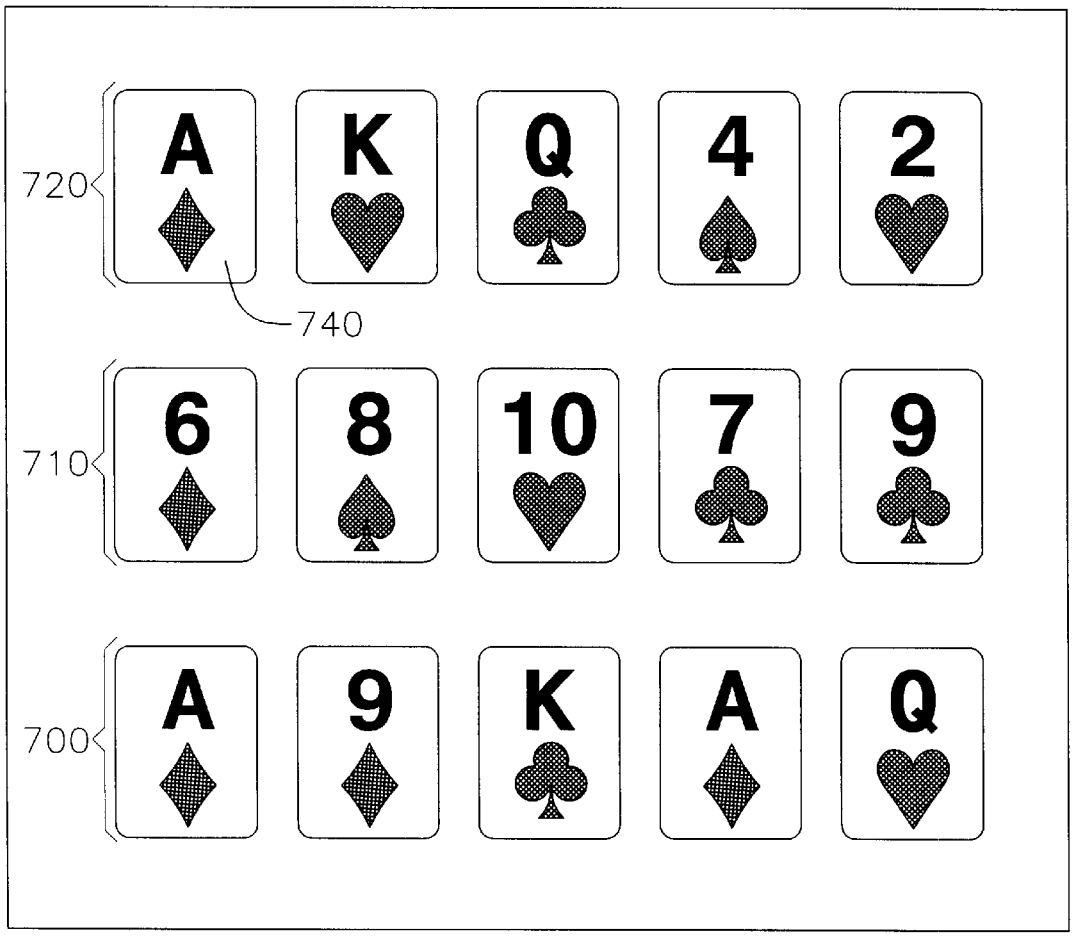
FIG. 11 shows a screen display according to the embodiment of FIG. 7 after the Ace of Diamonds in the top row has been duplicated and has replaced the Five of Spades in the bottom row.
Figure 12:
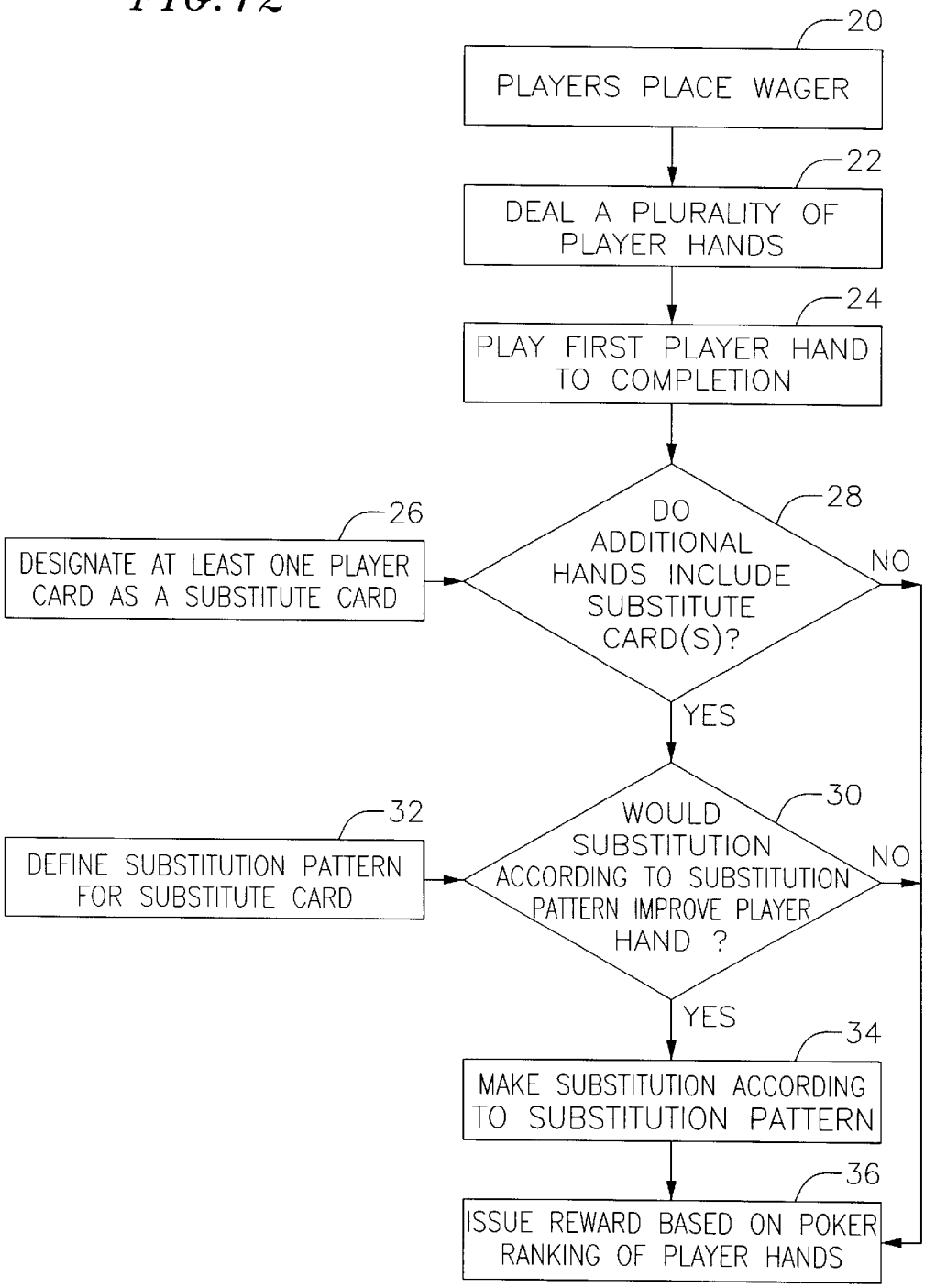
FIG. 12 shows a flowchart according to an embodiment of the method of the present invention.

FIG. 11 shows that the Ace of Diamonds 740 from the top hand 720 has been replicated and has replaced the Five of Spades 751 (FIG. 10) because by doing so it has improved the rank of the bottom hand 700 from an Ace High hand to a hand that ranks as a Pair of Aces. Also notice that the Ace of Diamonds 740 did not replicate itself into the middle hand 710 because it would not have improved the rank of the middle hand 710 because it already ranks as a Straight.

At this point the game is over and the player would be rewarded for the winning hands of Straight for the middle hand 710 and a Pair of Aces in the first player hand 700.

While certain embodiments of the present invention have been shown and described it is to be understood that the present invention is subject to many modifications and changes without departing from the spirit and scope of the claims presented herein.

TABLE 1

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 80 |
| Four of a Kind (2 thru King) | 25 |
| Full House | 8 |
| Flush | 5 |
| Straight | 4 |
| Three of a Kind | 3 |
| Two Pair | 2 |
| Pair of Jacks or Better | 1 |

TABLE 2

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 80 |
| Four of a Kind (2 thru King) | 50 |
| Full House | 9 |
| Flush | 6 |
| Straight | 4 |
| Three of a Kind | 3 |
| Two Pair | 1 |
| Pair of Jacks or Better | 1 |

TABLE 3

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 50 |
| Four of a Kind (2 thru King) | 25 |
| Full House | 9 |
| Flush | 6 |
| Straight | 4 |
| Three of a Kind | 3 |
| Two Pair | 2 |
| Pair of Jacks or Better | 1 |

We claim:

1. A method of playing a card game, comprising:

designating at least one playing card to be a substitute card;

defining a substitution pattern for said substitute card;

dealing a first player hand of cards; playing the first player hand to completion;

determining a poker rank of the completed first player hand;

dealing at least one additional player hand of cards;

for each substitute card in the additional player hands, replacing a card in another player hand with a replica of the substitute card according to the predefined substitution pattern only if the replacement results in an improved poker rank for the player hand receiving the substitute card; and rewarding the player hands according to the poker rank of each player hand after replacement, if any.

2. The method of claim 1 wherein the cards of each player hand are arranged in an array with each card assigned a card position, said substitution pattern comprising said substitute card replacing a card in another player hand in a corresponding card position only.

3. The method of claim 1 wherein the cards of each player hand are arranged in an array with each card assigned a card position and said player hands are dealt serially with each player hand adjacent at least one other player hand, said substitution pattern comprising said substitute card replacing a card in an adjacent player hand in a corresponding card position only.

4. A method of playing a card game, comprising:

designating at least one playing card to be a substitute card;

defining a substitution pattern for said substitute card;

dealing a first player hand of cards;

playing the first player hand to completion;

determining a poker rank of the completed first player hand;

dealing at least a second player hand of cards and a third player hand of cards;

for each substitute card of the third player hand, replacing a card in the first or second player hand with a replica of the substitute card according to the predefined substitution pattern only if the replacement results in an improved poker rank for the player hand receiving the substitute card;

for each card of the second player hand, replacing a card in the first or third player hand with a replica of the substitute card for a card according to the predefined substitution pattern only if the replacement results in an improved poker rank for the player hand receiving the substitute card; and rewarding the player hands according to the poker rank of each player hand after replacement, if any.

5. The method of claim 4 wherein the cards of each player hand are arranged in an array with each card assigned a card position, said substitution pattern comprising said substitute card replacing a card in another player hand in a corresponding card position only.

6. The method of claim 4 wherein the cards of each player hand are arranged in an array with each card assigned a card position and said player hands are dealt serially with each player hand adjacent at least one other player hand, said substitution pattern comprising said substitute card replacing a card in an adjacent player hand in a corresponding card position only.

7. A method of playing a card game, comprising:

designating at least one playing card to be a substitute card;

defining a substitution pattern for said substitute card;

dealing a first player hand of cards;

playing the first player hand to completion;

determining a poker rank of the completed first player hand;

dealing a second player hand of cards;

for each card of the second player hand, replacing a card in the first player hand with a replica of the substitute card according to the predefined substitution pattern only if the replacement results in an improved poker rank for the first player hand; and rewarding the first and second hands according to the poker rank of the first and second player hand after replacement, if any.

8. The method of claim 7 wherein the cards of each player hand are arranged in an array with each card assigned a card position, said substitution pattern comprising said substitute card replacing a card in another player hand in a corresponding card position only.

9. The method of claim 7 wherein the cards of each player hand are arranged in an array with each card assigned a card position and said player hands are dealt serially with each player hand adjacent at least one other player hand, said substitution pattern comprising said substitute card replacing a card in an adjacent player hand in a corresponding card position only.

10. A method of playing a card game, comprising:

designating at least one playing card to be a substitute card;

defining a substitution pattern for said substitute card;

dealing a first player hand of cards;

selecting zero or more cards to hold;

discarding cards not held;

completing the first player hand by dealing additional cards to replace the discarded cards;

determining a poker rank of the completed first player hand;

dealing at least one additional player hand of cards;

examining each additional player hand in serial fashion and for each substitute card in the additional player hands including any substitute card replicas received from another player hand, replacing a card in another player hand with a replica of the substitute card according to the predefined substitution pattern only if the replacement results in an improved poker rank for the player hand receiving the substitute card; and rewarding each player hand individually according to the poker rank of each player hand after replacement, if any.

11. The method of claim 10 wherein the cards of each player hand are arranged in an array with each card assigned a card position, said substitution pattern comprising said substitute card replacing a card in another player hand in a corresponding card position only.

12. The method of claim 10 wherein the cards of each player hand are arranged in an array with each card assigned a card position and said player hands are dealt serially with each player hand adjacent at least one other player hand, said substitution pattern comprising said substitute card replacing a card in an adjacent player hand in a corresponding card position only.

13. A method of playing a card game, comprising:

designating at least one playing card to be a substitute card;

defining a substitution pattern for said substitute card;

dealing a first player hand of cards;

selecting zero or more cards to hold;

discarding cards not held;

completing the first player hand by dealing additional cards to replace the discarded cards;

determining a poker rank of the completed first player hand;

dealing at least a second player hand of cards and a third player hand of cards;

for each substitute card of the third player hand, replacing a card in the second player hand with a replica of the substitute card for a card in the second player hand according to the predefined substitution pattern only if the replacement results in an improved poker rank for the second player hand;

for each substitute card of the second player hand, including any substitute card replicas received from the third player hand, replacing a card in the first player hand with a replica of the substitute card according to the predefined substitution pattern only if the replacement results in an improved poker rank for the first player hand; and rewarding each player hand individually according to the poker rank of each player hand after replacement, if any.

14. The method of claim 13 wherein the cards of each player hand are arranged in an array with each card assigned a card position, said substitution pattern comprising said substitute card replacing a card in another player hand in a corresponding card position only.

* * * * *